US005733006A

United States Patent [19]

Woods

[11] Patent Number: 5,733,006

[45] Date of Patent: Mar. 31, 1998

[54] SWIVEL SEAT SUSPENSION WITH FREE-SWIVEL FEATURE

[75] Inventor: Perry Wayne Woods, Davenport, Iowa

[73] Assignee: Sears Manufacturing Company, Davenport, Iowa

[21] Appl. No.: 641,623

[22] Filed: May 2, 1996

[51] Int. Cl.[6] ..... A47C 3/18

[52] U.S. Cl. ..... 297/344.22; 74/527; 74/529; 248/418; 248/425

[58] Field of Search ..... 248/425, 418; 297/344.22; 74/529, 527

[56] References Cited

U.S. PATENT DOCUMENTS

| | | | |
|---|---|---|---|
| 2,721,604 | 10/1955 | Salvadore et al. | 248/425 |
| 3,109,320 | 11/1963 | Krautwurst | 74/529 |
| 3,134,568 | 5/1964 | Carson . | |
| 3,570,800 | 3/1971 | Cycowicz . | |
| 3,659,895 | 5/1972 | Dresen . | |
| 3,789,444 | 2/1974 | McCord . | |
| 3,860,283 | 1/1975 | Colautti . | |
| 4,026,164 | 5/1977 | Mozingo | 74/529 X |
| 4,097,016 | 6/1978 | Petrucci . | |

FOREIGN PATENT DOCUMENTS

| | | | |
|---|---|---|---|
| 756266 | 9/1956 | United Kingdom | 74/529 |

*Primary Examiner*—Derek J. Berger
*Assistant Examiner*—Donald J. Wallace
*Attorney, Agent, or Firm*—Niro, Scavone, Haller & Niro

[57] ABSTRACT

The present invention provides a seat swivel assembly which allows a seat to swivel between stationary positions or to freely swivel about an axis, having an upper swivel plate and a lower swivel plate, a swivel member rotatably mounted to one of the plates, a swivel actuator lever in communication with the swivel member, a free-swivel latch facilitating unencumbered free swivel of the swivel plate, and a release lever in communication with the free swivel latch to release the swivel member to prevent free swivel.

14 Claims, 2 Drawing Sheets

SWIVEL SEAT SUSPENSION WITH FREE-SWIVEL FEATURE

BACKGROUND OF THE INVENTION

This invention relates to seat suspensions and, more particularly, to seat suspensions including swivel assemblies. The present invention provides a seat suspension having a swivel assembly which allows a seat occupant to rotatably adjust the seat and includes a "free-swivel" feature which allows unencumbered rotation of the seat.

Various seat assemblies are in use today which provide a seat that swivels about a central axis. These seat suspensions, however, do not typically include a free-swivel feature which allows the seat occupant to freely swivel without requiring continued actuation of a swivel lever or handle.

Such a seat suspension would be very useful in industrial and construction vehicles and the like where the vehicle operator must operate some implement, such as a backhoe or hydraulic shovel, in various rotational orientations relative to the vehicle itself. In such applications, it can be very difficult to operate the machinery while attempting to also hold a lever or handle on the seat to establish or maintain rotation of the vehicle seat. In such instances, as well as many others where free swivel is desired, the present invention is extremely useful in allowing a seat occupant to both adjust the seat rotationally for sustained operation in a single rotational orientation and to freely swivel without the need to hold or grasp a handle or lever.

SUMMARY OF THE INVENTION

Often times, as explained just above, seats are needed which rotate and can be adjustably positioned 360 degrees and which also can freely swivel 360 degrees, i.e., without the seat occupant having to hold a lever or handle. The swivel seat suspension of the present invention provides such a seat suspension assembly which allows a seat occupant to rotatably adjust a seat in any position with 360 degrees of rotation. The seat suspension of the present invention also allows a seat occupant to place and maintain the seat in a free-swivel mode whereby the seat will freely swivel without any further intervention from the seat occupant. The seat suspension of the present invention also allows the seat occupant to quickly and conveniently release the free-swivel feature to hold the seat in an adjusted, non-rotating position.

The swivel suspension of the present invention utilizes an upper swivel plate and a lower swivel plate which rotate relative to one another about an axis, one of which carries a swivel assembly and the other includes a plurality of stop apertures arranged in a circular fashion about the axis. The swivel assembly includes a swivel member having a stop pin biased to engage one of the plurality of stop apertures which allows the swivel plates to be locked in any one of a variety of rotational orientations relative to one another. The swivel assembly also includes a swivel lever and a release lever, and a resilient latch disposed to engage the swivel member and place the swivel plate in a free-swivel mode. The swivel lever is operably associated with the swivel member to disengage the stop pin from a stop aperture. The release lever is operably associated with the resilient latch to release the swivel member from engagement with the latch, and disable the free swivel mode.

It is, therefore, a primary object of the present invention to provide a seat suspension which allows a seat to be rotatably adjusted within 360 degrees of travel.

It is another primary object of the present invention to provide a seat suspension which can be placed in a free-swivel mode which allows the seat to be freely rotatable within 360 degrees of travel without continued manual manipulation by the seat occupant.

It is another object of the present invention to provide a seat suspension which can be rotatably adjusted and can be placed in a free-swivel mode which allows the seat to be freely rotatable without intervention from the seat occupant within 360 degrees of travel.

It is still another object of the present invention to provide an inexpensive seat suspension which can be both rotatably adjusted and can be placed in a free-swivel mode.

It is yet another object of the present invention to provide an inexpensive seat suspension which can be rotatably adjusted and independently placed in a free-swivel mode but which uses mechanically coupled free swivel and adjustment assemblies.

It is a still further object of the present invention to provide a seat suspension which can be rotatably adjusted and can be placed in a free-swivel mode using a single handle assembly which travels with the seat.

DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
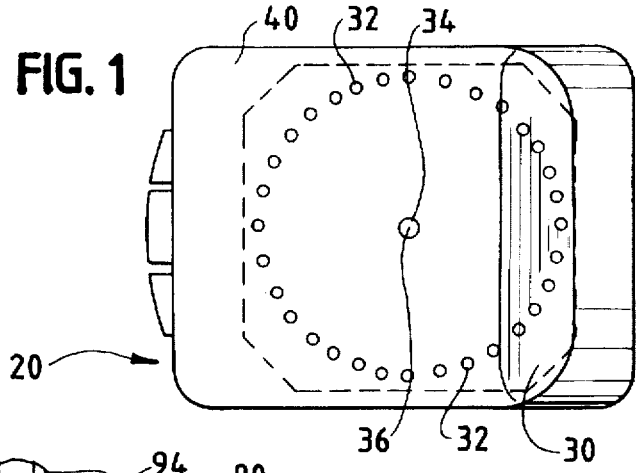
FIG. 1 is a top, partially cutaway view of the seat suspension of the present invention.

The swivel assembly of the present invention, designated generally 20, has a lower swivel plate 30 and an upper swivel plate 40, and a swivel actuator assembly, designated generally 50, attached to upper swivel plate 40 allowing rotational adjustment and free swivel of upper swivel plate 40 about lower swivel plate 30. Lower swivel plate 30 has a plurality of swivel stop apertures 32 arranged in a circular fashion around a central aperture 34 defining swivel axis 36. Upper swivel plate 40 is rotatably mounted to lower swivel plate 30 by any suitable means as is known to those of ordinary skill in the art.

Figure 2:
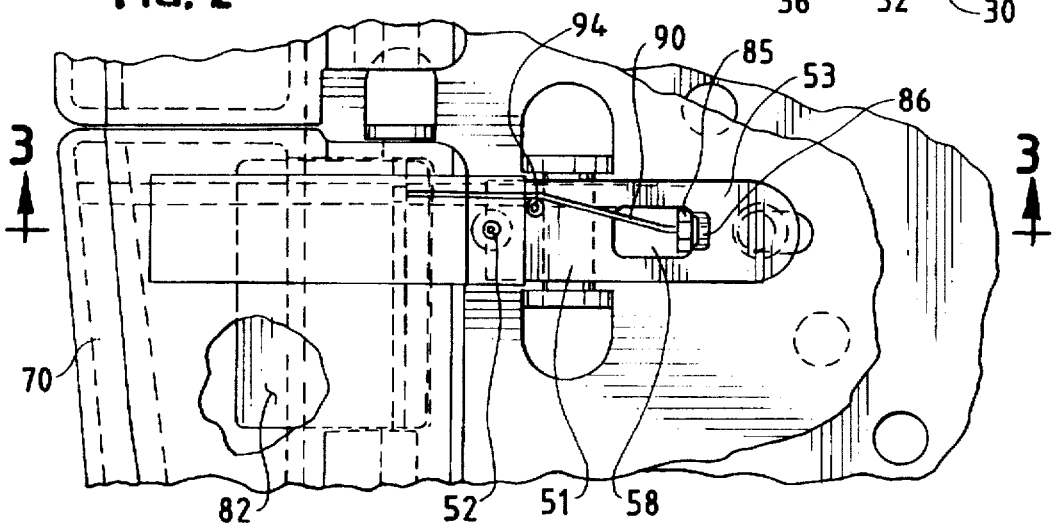
FIG. 2 is a partial top view of the swivel actuator assembly of the present invention.
Figure 3:
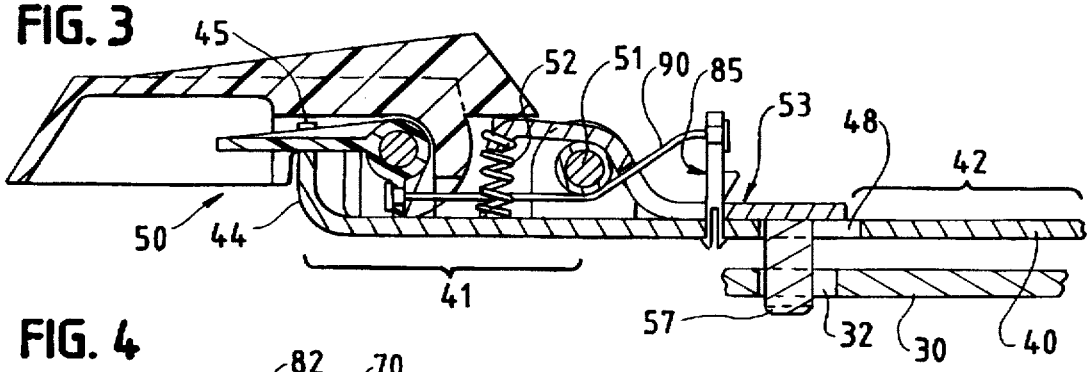
FIG. 3 is a cross-sectional view of the swivel actuator assembly of the present invention taken along line 3—3 of FIG. 2.
Figure 4:
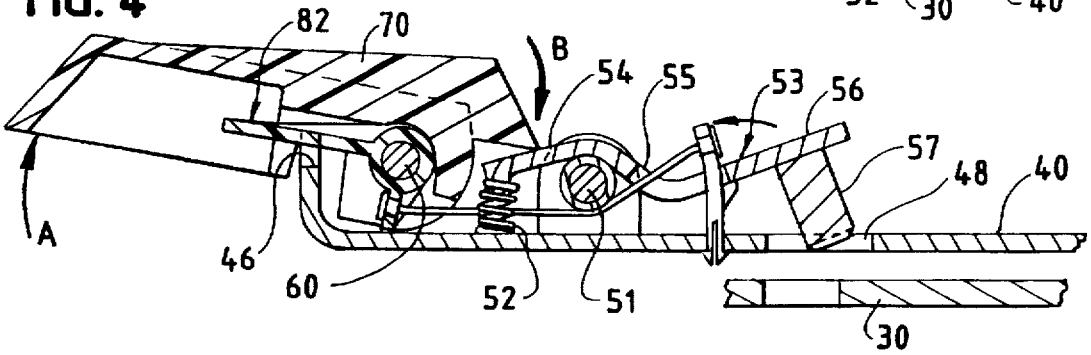
FIG. 4 is a cross-sectional view of the swivel actuator assembly of the present invention similar to that of FIG. 3 but showing the swivel stop pin disengaged from the lower swivel plate.

Referring to FIGS. 2 through 4, upper swivel plate 40 has a peripheral portion 41 and a central portion 42. Peripheral portion 41 includes an upwardly directed flange 44 having edges 45 and 46. A pin aperture 48 resides on the same radius and over stop apertures 32 of lower swivel plate 30. Swivel member 53 is mounted via first pivot 51 and acts as a pawl to prevent or allow swiveling of upper swivel plate 40 relative to lower swivel plate 30.

Swivel member 53 has a base 54, intermediate portion 55 and free end 56. Base 54 is rotatably attached to and extends over first pivot 51 and preferably is welded thereto. The intermediate portion 55 extends downward from base 54 to free end 56. Depending from the free end 56 is stop pin 57 extending through pin aperture 48 and into one of the plurality of stop apertures 32 of lower swivel plate 30. Stop pin 57 being disposed within a stop aperture 32 thereby prevents upper swivel plate 40 from rotating relative to lower swivel plate 30.

Stop pin 57 is biased to reside within a stop aperture 32 by compression spring 52 in communication with base 54 of swivel member 53.

A swivel actuation lever 70 is rotatably secured to a second pivot 60 and includes surface 72 and handle 74. Handle 74 extends outwardly from peripheral portion 41 of upper swivel plate 40 and rests on edge 45 of flange 44 in its stationery position. In normal operating conditions, handle 74 will be biased downward by compression spring 52 and by upholstery or a seat cushion (not shown) attached to upper swivel plate 40, but any means as is known to those of ordinary skill in the art is sufficient. Surface 72 of swivel actuator lever 70 resides above and abuts base 54 of swivel member 53. Thus, raising handle 74 as shown by arrow A in FIG. 4 causes surface 72 to move downward, as shown by arrow B in FIG. 4. Surface 72 moving downward causes the base 54 of swivel member 53 to move downward, which raises its free end 56 and lifts stop pin 57 out of engagement with an aperture 32 of lower swivel plate 30. Raising handle 74 thus allows rotation of upper swivel plate 40 about axis 36 relative to lower swivel plate 30.

Upper swivel plate 40 will swivel relative to lower swivel plate 30 as long as handle 74 is raised holding stop pin 57 out of engagement with stop apertures 32 of lower swivel plate 30. Releasing handle 74 will allow stop pin 57 to re-engage with a stop aperture 32 of lower swivel plate 30 and thereby prevent further rotation of upper swivel plate 40 relative to lower swivel plate 30.

Mechanically situated with the above-described rotational adjustment assembly is free-swivel assembly 80 comprising resilient latch 85 and release lever 82 rotatably coupled to second pivot 60 and communicating with resilient latch 85 via cable 90. Free swivel assembly 80 operates independently of, but in conjunction with, rotatable adjustment and allows the seat to be placed in a free-swivel mode and to be easily released from the free-swivel mode as explained below.

Figure 5:
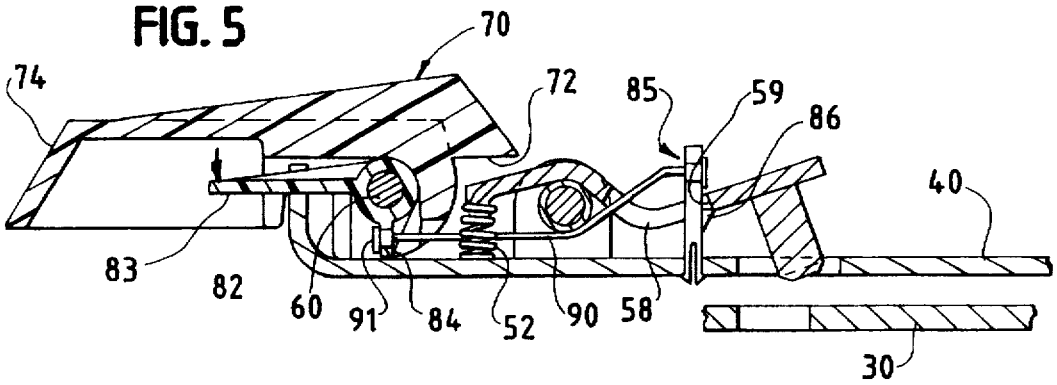
FIG. 5 is a cross-sectional view of the swivel actuator assembly of the present invention in the free-swivel mode.
Figure 6:
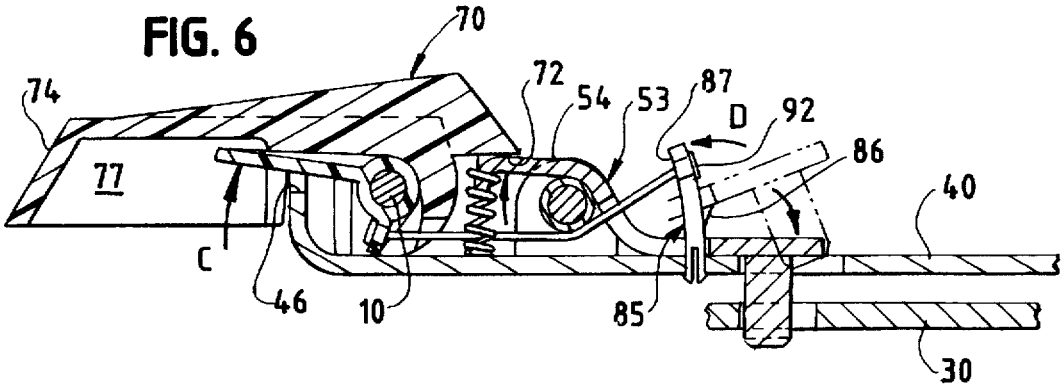
FIG. 6 is a cross-sectional view of the swivel actuator assembly of the present invention showing the free-swivel feature being de-actuated.
Figure 7:
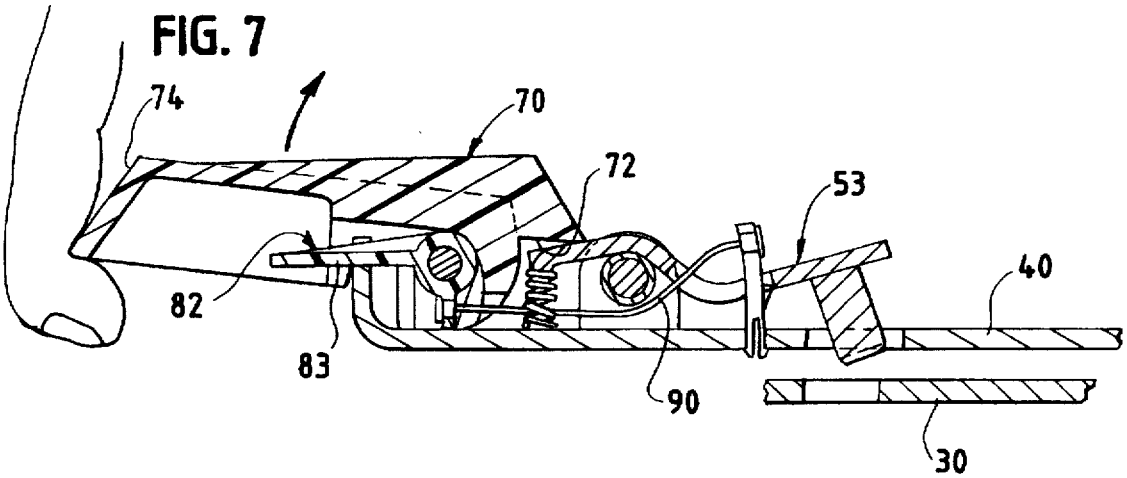
FIG. 7 is a cross-sectional view of the swivel actuator assembly of the present invention showing the swivel lever being activated for rotatable adjustment.

Referring to FIGS. 5 through 7, the free swivel assembly of the seat suspension of the present invention includes an elongated, resilient latch 85 disposed in upper swivel plate 40. Latch 85 works to retain swivel member 53 and stop pin 57 in an upwardly displaced, disengaged position, as shown in FIG. 5, to allow upper swivel plate 40 to freely swivel relative to lower swivel plate 30. Latch 85 extends upward through aperture 58 in intermediate section 55 of swivel member 53 and abuts edge 59 of swivel member 53. Resilient latch 85 includes integral tab 86 extending from a central portion thereof and extends over edge 59 of swivel member 53.

As explained above, raising handle 74 raises and disengages stop pin 57 from a stop aperture 32 of lower swivel plate 30. As the free end 56 of swivel member 53 rises, edge 59 causes resilient latch 85 to deflect. Handle 74 has a maximum rotational capacity of approximately 20°. After handle 74 rotates more than approximately 15°, the free end 56 of swivel member 53 is raised so that edge 59 clears tab 86 thereby preventing stop pin 57 from dropping and re-engaging stop apertures 32 of lower swivel plate 30. Once tab 86 catches edge 59, handle 74 can be released and upper swivel plate 40 will remain in a free swivel mode relative to lower swivel plate 30. Handle 74 therefore can be operated to rotatably adjust the position of upper swivel plate 40 or to place upper swivel plate 40 in a free-swivel mode.

Once placed in the free-swivel mode, upper swivel plate 40 may be again prevented from rotation by actuating release lever 82. Release lever 82 is rotatably coupled to second pivot 60 in independent, coaxial relationship with swivel actuator lever 70, and preferably resides within a housing 77 defined by handle 74, as seen in FIG. 6.

As shown in FIG. 5, release lever 82 extends from second pivot 60 to arm 83, and has downward, radially extending flange 84. Coupled to flange 84 is cable 90 secured by first cap 91 or any other suitable means which is well known to those of ordinary skill in the art. Cable 90 extends rearward from flange 84, around pin 94 to avoid compression spring 52 as seen in FIG. 2, under first pivot 51 as seen in FIG. 3, to a top portion 87 of resilient latch 85 where cable 90 is secured via second cap 92, or other suitable means. Top portion 87 of latch 85 is that portion of latch 85 above tab 86.

Release lever 82 thus communicates with latch 85 via cable 90. In its non-actuated position, arm 83 of release lever 82 rests on edge 46 of flange 44 of upper swivel plate 40, as seen in FIG. 7. Raising arm 83 of release lever 82, shown by Arrow C in FIG. 6, pulls cable 90, which displaces the top portion 87 of latch 85, as shown by Arrow D in FIG. 6. When stop pin 57 is held in its raised position via edge 59 resting on tab 86, release lever 82 can be actuated to release edge 59 from tab 86, thus causing stop pin 57 to re-engage a stop aperture 32 of lower swivel plate 30. Actuating release lever 82 thereby de-actuates the free-swivel feature and prevents upper swivel plate 40 from freely swiveling about lower swivel plate 30.

As will be appreciated, the above described swivel actuation assembly with free-swivel feature allows rotational adjustment and free swivel of upper swivel plate 40 about lower swivel plate 30. Further, the swivel suspension assembly 20 allows handle 74 and arm 83 to travel with upper swivel plate 40 for convenient operation of each. Additionally, the present swivel assembly invention provides a wholly independent free swivel feature with an adjustable rotation feature which are mechanically coupled for convenient assembly and maintenance. Moreover, the seat suspension assembly of the present invention allows a seat occupant to freely swivel without having to hold a handle in position, thus freeing up the seat occupant's hands to operate a vehicle.

Of course, it should be understood that various changes and modifications to the preferred embodiments described herein will be apparent to those skilled in the art. Other changes and modifications, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

What is claimed is:

1. A seat swivel apparatus comprising:

a lower swivel plate;

an upper swivel plate rotatably mounted to said lower swivel plate and adapted to support a seat;

a swivel actuator assembly mounted to one of said plates and a plurality of stop apertures arranged in the other of said plates;

said swivel actuator assembly including (i) a swivel member having a stop pin biased to engage one of said apertures, (ii) a swivel lever operably associated with the swivel member to disengage the stop pin from said one aperture; (iii) a resilient latch disposed on the one of said plates to engage said swivel member and lock said stop pin from re-engaging said one aperture; and (iv) a release operably associated with said latch to release the swivel member and permit the stop pin to re-engage said one aperture, such that said swivel member has an adjusted mode and a free-swivel mode allowing uninhibited rotation of said upper swivel plate without further actuation of said swivel lever.

2. The apparatus of claim 1 wherein said release is housed within said swivel lever.

3. The apparatus of claim 1 wherein the upper swivel plate and the lower plate each comprise a one-piece stamped metal pan.

4. The apparatus of claim 1 wherein the swivel actuator assembly comprises at least a first pivot and a second pivot, the swivel member attached to the first pivot, and the release and the swivel lever attached to the second pivot.

5. The apparatus of claim 1 wherein the stop pin is integral to the swivel member.

6. The apparatus of claim 1 wherein the swivel actuator assembly further comprises a spring biasing the stop pin into engagement with the one of said apertures.

7. The apparatus of claim 1 wherein activation of the swivel lever a predetermined amount places the swivel plates in a free-swivel mode, and activation of the release terminates the free-swivel mode.

8. The apparatus of claim 1 wherein the swivel lever has an activated position and a non-activated position and is biased into its non-activated position by a seat cushion.

9. The apparatus of claim 1 wherein the swivel plates have front and rear portions, and the swivel actuator assembly is mounted to the front portion of the one of said plates.

10. The apparatus of claim 1 wherein the swivel lever and the release extend from the one of said plates for convenient actuation.

11. The apparatus of claim 1 wherein the resilient latch communicates with the release via a cable.

12. A seat swivel apparatus comprising:

a lower swivel plate;

an upper swivel plate rotatably mounted to said lower swivel plate and adapted to support a seat;

a swivel actuator assembly mounted to one of said plates and a plurality of stop apertures arranged in the other of said plates;

said swivel actuator assembly including (i) a swivel member having a stop pin biased to engage one of said apertures, (ii) a swivel lever operably associated with the swivel member to disengage the stop pin from said one aperture; (iii) a resilient latch disposed to engage said swivel member and lock said stop pin from re-engaging said one aperture; and (iv) a release operably associated with said latch to release the swivel member and permit the stop pin to re-engage said one aperture;

wherein the resilient latch is removably disposed within an aperture in the one of said swivel plates.

13. A seat suspension assembly which allows the seat to swivel freely and to be adjustably rotated, comprising:

an upper swivel plate and a lower swivel plate rotatably joined about an axis and a swivel actuator assembly operably attached to one of the swivel plates, the other of the swivel plates having a plurality of stop apertures arranged circularly about the axis, said swivel actuator assembly including a first and a second pivot;

a swivel member rotatably coupled to the first pivot and having a depending stop pin biased to engage one of the plurality of stop apertures to prevent rotation of the upper swivel plate;

a swivel lever and a release lever rotatably coupled to the second pivot, the swivel lever communicating with the swivel member;

a resilient free-swivel latch operably associated with the release lever and having a tab disposed to communicate with the swivel member;

such that operation of the swivel lever causes the stop pin to be disengaged from the one stop aperture allowing the upper swivel plate to swivel, and operation of the swivel lever a predetermined amount causes the tab to lock the stop pin from re-engaging one of the plurality of stop apertures, and actuation of the release lever disengages the tab allowing the stop pin to engage one of the plurality of stop apertures.

14. A seat suspension assembly which allows the seat to swivel freely and to be adjustably rotated, comprising:

an upper swivel plate having a forward portion and a swivel actuator assembly operably attached to the forward portion, rotatably attached to a lower swivel plate about an axis, the lower swivel plate having a plurality of stop apertures arranged circularly about the axis, said swivel actuator assembly comprising a first pivot and a second pivot;

a swivel member having a forward section, an intermediate section and a rearward section rotatably coupled to the first pivot and having a depending swivel stop pin biased to reside in one of the plurality of stop apertures to prevent rotation of the upper swivel plate, the intermediate section having an edge;

a swivel lever and a release lever rotatably coupled to the second pivot, the swivel lever communicating with the swivel member;

a resilient free-swivel latch disposed in said upper swivel plate and having a tab in proximity to said edge and communicating with the release lever;

such that raising the swivel lever causes the stop pin to be removed from one of the plurality of stop apertures allowing the upper swivel plate to swivel, and raising the swivel lever a predetermined amount causes the tab to engage and prevent the stop pin from re-engaging one of the plurality of stop apertures, and actuating the release lever disengages the edge from the tab allowing the stop pin to engage one of the plurality of stop apertures.

* * * * *